United States Patent [19]

Melde-Tuczai et al.

[11] Patent Number: 4,917,169

[45] Date of Patent: Apr. 17, 1990

[54] CASTING CORE FOR A WATER JACKET

[75] Inventors: Helmut Melde-Tuczai, Graz; Wilhelm Greylinger, Mürzzuschlag; Klaus Nowotny, Graz, all of Austria

[73] Assignee: AVL Gesellschaft für Verbrennungskraftmaschinen und Messtechnik, Graz, Austria

[21] Appl. No.: 232,172

[22] Filed: Aug. 15, 1988

[30] Foreign Application Priority Data

Aug. 20, 1987 [AT] Austria ..... 2097/87

[51] Int. Cl.[4] ..... B22C 9/10; B22C 21/14

[52] U.S. Cl. ..... 164/369; 164/370; 164/397

[58] Field of Search ..... 164/369, 370, 366, 367, 164/365, 368, 397, 230, 231

[56] References Cited

FOREIGN PATENT DOCUMENTS 0197365 3/1986 European Pat. Off. .

3300924 7/1984 Fed. Rep. of Germany .

55-133848 10/1980 Japan ..... 164/366

60-76249 4/1985 Japan ..... 164/366

60-47033 10/1985 Japan ..... 164/366

62-168639 7/1987 Japan ..... 164/369

*Primary Examiner*—Nicholas P. Godici

*Assistant Examiner*—J. Reed Batten, Jr.

*Attorney, Agent, or Firm*—Watson, Cole, Grindle & Watson

[57] ABSTRACT

In a casting core for the water jacket of a cylinder block in a multicylinder, reciprocating-piston internal combustion engine, whose cylinders are arranged in line and are cast in one piece linked by cylinder webs, these webs are provided with rectangular plates of a ceramics material—preferably sintered oxide ceramics—, which are used as supports for two core halves, in which they are anchored in such a way as to present a one-piece casting core. The supports are removed during the core cleaning process, leaving passages for the cooling water.

5 Claims, 2 Drawing Sheets

CASTING CORE FOR A WATER JACKET

BACKGROUND OF THE INVENTION

This invention relates to a casting core for the water jacket of a cylinder block in a multicylinder, reciprocating-piston internal combustion engine, whose cylinders are arranged in line and are cast in one piece linked by webs, the two halves of the core arranged on the long sides of the cylinder block being held together by the core sections on the front ends of the cylinder block and being secured by supports piercing the cylinder webs. Contrary to this proposal the cores for the water jackets of the conventional types of cylinder blocks, with separated cylinders and passages for the cooling water between these cylinders, are provided with integrated cores for the cooling passages. In these instances no additional supports for securing the two halves of the core are required.

DESCRIPTION OF THE PRIOR ART

Because of today's trend ever smaller engines with increased specific performance, the clearance between the cylinders, i.e., the web, has become much narrower in cylinder blocks with cast-in liners, and it is no longer possible to place the core for a water jacket of standard dimensions in between the cylinder tubes. For this reason the cylinder tubes are cast in one piece, with the use of casting cores of the known type described above.

Cylinder blocks with cylinder liners cast in one piece have disadvantages with regard to cooling that may cause knocking in engines of the spark-ignition type, for example; in diesel engines the inhomogeneous temperature distribution must be compensated by an expensive design.

In order to avoid these disadvantages while ensuring a small distance between cylinders, a known technique consists of piercing the webs by drilling or milling, in order to establish flow-connections across the cylinder webs between the cooling water chambers located on the two long sides of the cylinder block, and thus to improve cooling of the cylinders in the area of the cylinder webs. The kind and extent of such additional tooling will of course depend on the type of material used for the web, and will further increase cost.

European Patent Application No. 0 197 365 contains a description of cooling water passages that are formed in the valve webs by means of separate cores bridging the two opposed longitudinal sides of the core of the water jacket and fitted into the latter on both ends. The separate cores for the cooling water passages, which are extremely small, are made from high-compression zircon sand ensuring the required strength. When the separate cores are fitted, however, positional tolerances will ensue, which will lead to undesirable inaccuracies. Besides, these cores are not suitable for supporting the core of the water jacket because of their insufficient mechanical strength. Moreover, the passages cast in this way are subject to mineralization of the core sand because of their small dimensions, in addition to being unduly expensive on account or their separate cores.

In German Laid Open No. 33 00 924 a design is described according to which the area of the webs corresponding to the cylinder chamber is provided with cast-in tubes linking the cooling-water jackets on either side. Although the cast-in tube can be used as a support for the core, it may be damaged by cuts from the cylinder bore in some of the cylinder webs. The inevitable differences in material and surface qualities between the cast-in part and its surroundings make it less suited as a partner for the sliding piston rings than the cast bore of the housing.

SUMMARY OF THE INVENTION

It is an object of this invention to avoid the disadvantages of the known types of cylinder blocks and to facilitate the production of cylinder blocks with cooling passages running in the valve webs, even if the latter are extremely narrow and the cylinders are extremely close to one another.

This object is achieved by configuring each support as an essentially rectangular plate of ceramics, preferably sintered oxide ceramics, which has a thickness of 1.5 to 3 mm, preferably 1.7 mm, and is provided with anchoring elements along its edges running parallel to the cylinder axes in their built-in state, and by combining the core of the water jacket and the supports in a one-piece casting core by means of core-shooting.

In accordance with their basic function the supports are made from a ceramics material of adequate tensile strength and a shape permitting their incorporation into the core of the water jacket during the shooting process in such a way as to enable the making of a one-piece casting core. These supports may be produced with minimum thickness of 1.5 mm, and may be removed after casting, for instance by sandblasting during the core cleaning process, leaving behind cooling water passages whose cross-sections have an extremely small width. The length of the cross-sections may vary within a wide range. The cross-sections of these passages need not be strictly rectangular, but may have rounded corners, if so required. Moreover, the cylindrical shape may be abandoned in order to utilize the space provided for the cooling passages as best as possible.

In a further development of the invention the anchoring elements of the supports may be made by thickening the edges of the plates, their thickness preferably increasing towards the outside. This provides a simple way of anchoring the supports in the core of the water jacket. It is of advantage to place the supports close to the cylinder block top desk and to extend their thickened edges as far as to this packing face by means of projections, resulting in closed cooling passages upon casting, through which the cooling water may pass into the cylinder head.

BRIEF DESCRIPTION OF THE DRAWINGS

Following is a more detailed description of the invention as illustrated by the accompanying drawing, in which.

DETAILED DESCRIPTION OF A PREFERRED EMBODIMENT

Figure 1:
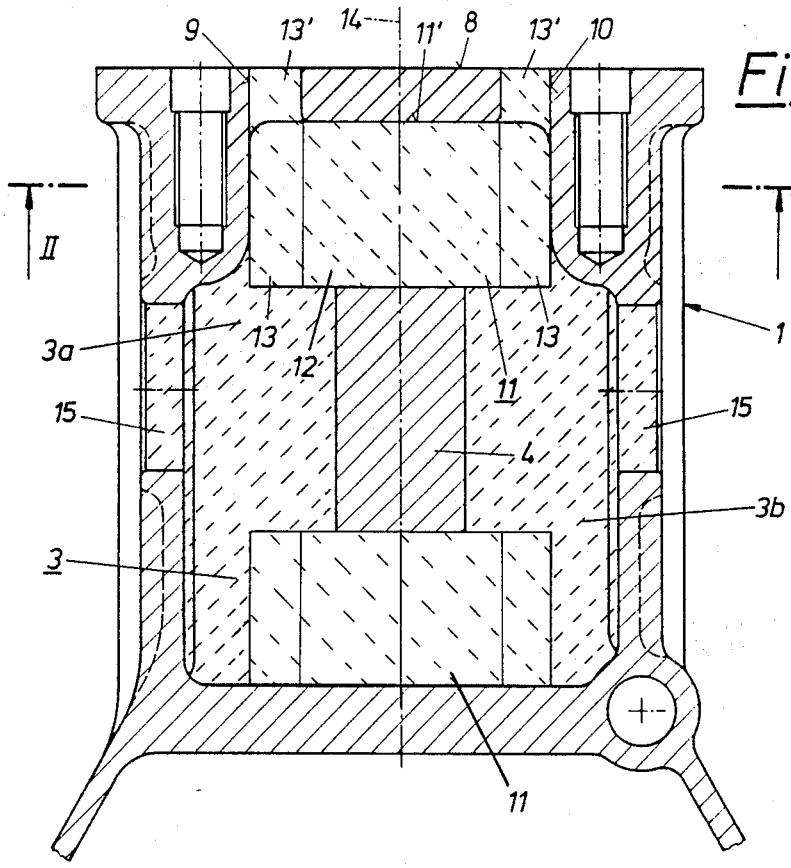
FIG. 1 shows a cylinder block with a casting core as proposed by the invention, cut parallel to the cylinder axes in accordance with line I—I in FIG. 2.
Figure 2:
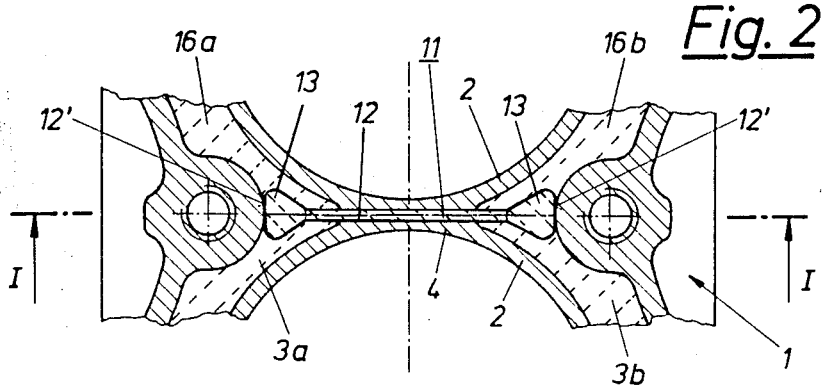
FIG. 2 is a fragmentary section along line II—II in FIG. 1.
Figure 3:
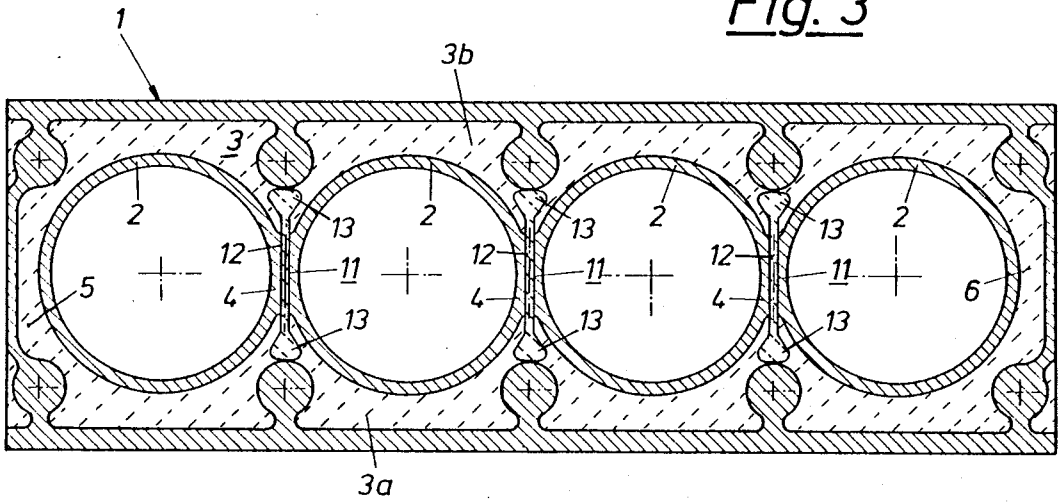
FIG. 3 is a section through the entire cylinder block according to FIG. 2, at a similar scale.

The cylinder block 1 of an internal combustion engine whose cylinders 2 are cast in one piece, has a water jacket casting core 3 which is divided into two longitudinal halves 3*a*, 3*b* by the zone where the cylinders meet, i.e., the cylinder web 4, which halves are held together only by the front end sections 5 and 6 of the casting core. Between every two cylinders 2 a core support 11 is provided, which is configured as a rectangular plate 12 with thickened ends 13 having edges 12' running parallel to the cylinder axis 14. The thickened ends 13 are extended beyond the upper edge 11' of the rectangular plate 12 by mans of projections 13' reaching as far as to the cylinder block top deck 8, such that passages 9,10 are formed through which the cooling water may enter the cylinder head.

The supports 11 are made from ceramics material, for example sintered oxide ceramics, such as aluminium or zirconium oxide, whose strength is such as to be capable of providing the necessary anchorage for the core halves in spite of the minute thickness of 1.5 to 3 mm required, resisting damage during core shooting, while being easily removable during core cleaning. In addition the supports may be coated or impregnated with some other material, which helps achieve the above properties before casting while presenting little resistance afterwards. Due to its ceramic properties this material is characterized by satisfactory resistance to the problem of mineralization.

For manufacture of a one-piece casting core according to the invention pre-fabricated ceramic supports are positioned in the core mold as required and are incorporated into the core upon shooting. After the casting process the supports 11 are removed through the lateral core holes 15 or the water passages 9,10, for example by sandblasting, such that the desired flow-connections are established between the two halves 16*a* and 16*b* of the water jacket.

Between the halves 3*a*, 3*b* of the core 3 of the water jacket a second support 11 may be mounted, which need not be removed after casting.

We claim:

1. A casing core for a water jacket of a cylinder block in a multicylinder, reciprocating-piston internal combustion engine, having a cylinder block top deck and cylinders which are arranged in line and are cast in one piece linked by cylinder webs, said casting core comprising two halves arranged on the long sides of said cylinder block being held together by core sections on the front ends of said cylinder block and being secured by supports piercing said cylinder webs, wherein each of said supports is configured as an essentially rectangular plate of ceramics, having a thickness of 1.5 to 3 mm, and being provided with ceramic anchoring elements along both edges of said plate running parallel to the cylinder axes and wherein said casting core of said water jacket and said supports are combined in a one-piece casting core by means of a core-shooting process.

2. A casting core according to claim 1, wherein said supports are made of sintered oxide ceramics.

3. A casting core according to claim 1, wherein said rectangular plates of said supports have a thickness of 1.7 mm.

4. A casting core according to claim 1, wherein said anchoring elements of said supports are made by thickening said edges of said plates and wherein the thickness increases towards the outside of said supports.

5. A casting core according to claim 4, wherein said supports are placed in close vicinity of said cylinder block top deck and wherein said thickened edges are extended through said cylinder block top deck by means of projections.

* * * * *

UNITED STATES PATENT AND TRADEMARK OFFICE

CERTIFICATE OF CORRECTION

PATENT NO. : 4,917,169

DATED : April 17, 1990

INVENTOR(S) : Helmut Melde-Tuczai et al.

It is certified that error appears in the above-identified patent and that said Letters Patent is hereby corrected as shown below:

On the title page, column 1, item (73) change the assignee to read --AVL Gessellschaft für Verbrennungskraft-maschinen und Messtechnik mbH. Prof. Dr.Dr. h.c. Hans List--.

Signed and Sealed this

Twenty-fourth Day of September, 1991

*Attest:*

HARRY F. MANBECK, JR.

*Attesting Officer*

*Commissioner of Patents and Trademarks*